US007530563B2

(12) United States Patent
Kuo

(10) Patent No.: US 7,530,563 B2
(45) Date of Patent: May 12, 2009

(54) PAPER-FEEDING MECHANISM OF AUTOMATIC DOCUMENT FEEDER

(75) Inventor: Ping-Hung Kuo, Taoyuan Hsien (TW)

(73) Assignee: Teco Image Systems Co., Ltd, Taoyuan Hsien (TW)

( * ) Notice: Subject to any disclaimer, the term of this patent is extended or adjusted under 35 U.S.C. 154(b) by 63 days.

(21) Appl. No.: 11/940,226

(22) Filed: Nov. 14, 2007

(65) Prior Publication Data

US 2008/0290586 A1 Nov. 27, 2008

(30) Foreign Application Priority Data

May 25, 2007 (TW) ..... 96118795 A

(51) Int. Cl.
*B65H 3/52* (2006.01)

(52) U.S. Cl. ..... 271/124; 271/117

(58) Field of Classification Search ..... 271/117, 271/118, 121, 124

See application file for complete search history.

(56) References Cited

U.S. PATENT DOCUMENTS 6,431,541 B2 * 8/2002 Kuo et al. ..... 271/118
6,991,227 B2 * 1/2006 Kim ..... 271/10.12
2003/0090053 A1 * 5/2003 Hsiao et al. ..... 271/118
2005/0184449 A1 * 8/2005 Morimoto et al. ..... 271/118
2006/0038339 A1 * 2/2006 Shimamura ..... 271/121
2007/0001374 A1 * 1/2007 Lee ..... 271/117

* cited by examiner

*Primary Examiner*—Patrick H Mackey
*Assistant Examiner*—Gerald W McClain
(74) *Attorney, Agent, or Firm*—Kirton & McConkie; Evan R. Witt

(57) ABSTRACT

A paper-feeding mechanism of an automatic document feeder includes a pick-up module, a supporting module and a paper stopping module. The pick-up module is used for picking an uppermost paper sheet from the stack of paper sheets and transporting the uppermost paper sheet into a passageway inside the automatic document feeder. The supporting module supports the pick-up module and is rotated to either ascend or descend the pick-up module, wherein the supporting module has a sustaining part on a sidewall thereof. When the supporting module and the pick-up module are downwardly rotated, the stopping plate is moved vertically to a paper-feeding position for allowing the uppermost paper sheet to be transported into the passageway. When the supporting module and the pick-up module are upwardly rotated, the stopping plate is moved vertically to a paper-stopping position for hindering the uppermost paper sheet from being transported into the passageway.

13 Claims, 8 Drawing Sheets

PAPER-FEEDING MECHANISM OF AUTOMATIC DOCUMENT FEEDER

FIELD OF THE INVENTION

The present invention relates to a paper-feeding mechanism, and more particularly to a paper-feeding mechanism of an automatic document feeder.

BACKGROUND OF THE INVENTION

With increasing power of personal computers, a diversity of office machines can be employed with the personal computers to achieve various purposes. The diverse office machines, however, occupy lots of space. A multifunction peripheral having multiple functions in one structural unit, for example the functions of a printer, a scanner, a fax machine and/or a copy machine, is thus developed. As a consequence, the processing capability of the multifunction peripheral is increased and the operative space thereof is reduced.

Nowadays, the printer, a scanner, a fax machine, a copy machine or the multifunction peripheral usually has an automatic document feeder for successively and continuously feeding many paper sheets. After a stack of papers to be scanned are placed on the sheet input tray of the automatic document feeder, the sheet-feeding mechanism of the automatic document feeder will successively transport the paper sheets into the inner portion of the office machine so as to implement associated operations such as scanning, faxing, scanning operations and the like.

Referring to FIG. 1(*a*), a schematic cross-sectional view of a conventional automatic document feeder for use with an office machine is illustrated. The automatic document feeder 10 of FIG. 1(*a*) principally includes a pick-up module 11, a transfer module 12, an ejection module 13, a paper input tray 14 and a paper ejecting tray 15. The office machine further includes an image processing module 19 and a glass platform 191 under the automatic document feeder 10.

After a stack of paper sheets 141 to be scanned are placed on the paper input tray 14, the pick-up module 11 may successively pick the uppermost paper sheets one by one into the passageway within the automatic document feeder 10. Next, the paper sheet 141 is transported by the transfer module 12 across the glass platform 191 so that a first side of the paper sheet is scanned by the image processing module 19. The paper sheet 141 whose first side has been scanned is then ejected to the paper ejecting tray 15 by the ejection module 13. For a purpose of performing a duplex scanning operation, the transfer module 12 further includes an inverting member 121 adjacent to the ejection module 13. After the first side of the paper sheet 141 has been scanned and a majority of the paper sheet 141 is ejected to the paper ejecting tray 15, the paper sheet 141 is turned over by the inverting member 121 and then fed into the passageway. Next, the paper sheet 141 is transported by the transfer module 12 across the glass platform 191 so that a second side of the paper sheet is scanned by the image processing module 19.

Please refer to FIG. 1(*a*) again. The pick-up module 11 includes a pick-up roller 16, a separation roller 17 and a paper stopping module 18 (as is also shown in FIG. 1(*b*)). The pick-up roller 16 is driven by a driving motor (not shown) to rotate and thus the pick-up roller 16 is either ascended or descended. When the pick-up roller 16 is descended to contact with the paper sheet 141, the paper sheet 141 is fed by the pick-up roller 16. The separation roller 17 is rotated to separate the uppermost paper sheet 141 from the stack of paper sheets, thereby picking a single paper sheet to the transfer module 12.

FIG. 1(*b*) is a schematic perspective view illustrating a paper stopping module 18 of the automatic document feeder 10. The paper stopping module 18 includes a rotating shaft 181, a clamp element 182 and a paper stopping plate 183. An end of the clamp element 182 is sheathed around the rotating shaft 181 and fixed by a spring 184. The stopping plate 183 is clamped by the other end of the clamp element 182. The rotating shaft 181 is driven by another motor (not shown) to rotate in either a clockwise or anti-clockwise direction. Due to the change of friction force between the rotating shaft 181 and the clamp element 182, the stopping plate 183 is pivotal about the rotating shaft 181. When the stopping plate 183 is rotated to the uppermost position or the lowermost position, idle running of the motor which is connected to the rotating shaft 181 is rendered.

In a case that no paper-feeding instruction is received by the automatic document feeder 10, the pick-up roller 16 is raised to a standby position. Meanwhile, the stopping plate 183 is correspondingly raised such that the paper sheets 141 on the paper input tray 14 are hindered from being transported into the paper feeding port.

Whereas, in a case that a paper-feeding instruction is received by the automatic document feeder 10, the motor which is connected to the rotating shaft 181 exerts a positive driving force on the rotating shaft 181. As a consequence, the rotating shaft 181 is rotated and the stopping plate 183 is rotated downwardly to the lowermost position. Meanwhile, the uppermost paper sheet may be transported into the paper feeding port without being stopped by the stopping plate 183. At that moment, the pick-up roller 16 is driven by the driving motor and lowered to a paper-feeding position where the pick-up roller 16 contacts with the uppermost paper sheet 141. The separation roller 17 is rotated to separate the uppermost paper sheet 141 from the stack of paper sheets, thereby picking a single paper sheet to the transfer module 12.

When a sensor (not shown) of the automatic document feeder 10 detects that the paper sheet 141 reaches the separation roller 17, the rotating shaft 181 is driven by the motor to rotate in a reverse direction and the pick-up roller 16 is raised to the standby position. Meanwhile, the clamp element 182 is also reverse rotated and the stopping plate 183 is correspondingly raised to stop the paper feeding port, thereby preventing the remainder paper sheets from being transported into the paper feeding port. Until the uppermost paper sheet is ejected to the paper ejecting tray 15, the above procedures are repeated to successively feed the remainder paper sheets one by one.

As previously described, after the first side of the paper sheet 141 has been scanned and a majority of the paper sheet 141 is ejected to the paper ejecting tray 15, the paper sheet 141 is turned over by the inverting member 121 and then fed into the passageway. Next, the paper sheet 141 is transported by the transfer module 12 across the glass platform 191 so that a second side of the paper sheet is scanned by the image processing module 19. Conventionally, when the paper sheet 141 is turned over by the inverting member 121 and fed into the passageway, the rotating shaft 181 is driven by the motor to rotate and the stopping plate 183 is rotated downwardly to the lowermost position. As known, the procedure of rotating the stopping plate 183 to the lowermost position is redundant at the moment when the paper sheet 141 is turned over by the inverting member 121 and fed into the passageway, because the paper sheet 141 comes from the paper ejecting tray 15 rather than the paper input tray 14. The frequent idle running of the motor for fixing the stopping plate 183 at the lowermost position may reduce the motor's operating life. Moreover, the use of the motor for driving the rotating shaft 181 increases the fabricating cost. In addition, the performance of stopping the paper sheets by the stopping plate 183 is usually unsatisfied. The rotation of the rotating shaft 181 may result in a drag force between the rotating shaft 181 and the clamp element 182, which increases the burden of the overall system.

In views of the above-described disadvantages resulted from the conventional method, the applicant keeps on carving unflaggingly to develop a paper-feeding mechanism of an automatic document feeder according to the present invention through wholehearted experience and research.

SUMMARY OF THE INVENTION

It is an object of the present invention to provide a paper-feeding mechanism of an automatic document feeder for enhancing performance of stopping the paper sheets, reducing the fabricating cost, and minimizing the operating burden.

In accordance with an aspect of the present invention, there is provided a paper-feeding mechanism of an automatic document feeder. The paper-feeding mechanism is coupled with a casing of the automatic document feeder for successively feeding a stack of paper sheets on a paper input tray. The paper-feeding mechanism includes a pick-up module, a supporting module and a paper stopping module. The pick-up module is disposed in the vicinity of the paper input tray for picking an uppermost paper sheet from the stack of paper sheets and transporting the uppermost paper sheet into a passageway inside the automatic document feeder. The supporting module supports the pick-up module and is rotated to either ascend or descend the pick-up module, wherein the supporting module has a sustaining part on a sidewall thereof. The paper stopping module is coupled to the casing and includes a stopping plate and a transmission member. A first end of the transmission member is in contact with the sustaining part. A second end of the transmission member is coupled with the stopping plate. When the supporting module and the pick-up module are downwardly rotated, the stopping plate is moved vertically to a paper-feeding position for allowing the uppermost paper sheet to be transported into the passageway. When the supporting module and the pick-up module are upwardly rotated, the stopping plate is moved vertically to a paper-stopping position for hindering the uppermost paper sheet from being transported into the passageway.

In an embodiment, the pick-up module includes a pick-up roller and a separation roller for picking the uppermost paper sheet from the stack of paper sheets and transporting the uppermost paper sheet into a passageway.

In an embodiment, the separation roller includes a separation roller axle, and the supporting module is pivotal about the separation roller axle.

In an embodiment, the transmission member includes a contact part to be contacted with the sustaining part of the supporting module and a clamp part for clamping an upper edge of the stopping plate.

In an embodiment, a pivotal shaft is disposed at a connection region of the clamp part and the contact part, and a grasp arm is protruded from an inner surface of the casing for grasping both terminals of the pivotal shaft.

In accordance with another aspect of the present invention, there is provided an automatic document feeder. The automatic document feeder includes a casing, a paper input tray for placing a stack of paper sheets thereon, and a paper-feeding mechanism. The paper-feeding mechanism includes a pick-up module, a supporting module and a paper stopping module. The pick-up module is disposed in the vicinity of the paper input tray for picking an uppermost paper sheet from the stack of paper sheets and transporting the uppermost paper sheet into a passageway inside the automatic document feeder. The supporting module supports the pick-up module and is rotated to either ascend or descend the pick-up module, wherein the supporting module has a sustaining part on a sidewall thereof. The paper stopping module is coupled to the casing and includes a stopping plate and a transmission member. A first end of the transmission member is in contact with the sustaining part. A second end of the transmission member is coupled with the stopping plate. When the supporting module and the pick-up module are downwardly rotated, the stopping plate is moved vertically to a paper-feeding position for allowing the uppermost paper sheet to be transported into the passageway. When the supporting module and the pick-up module are upwardly rotated, the stopping plate is moved vertically to a paper-stopping position for hindering the uppermost paper sheet from being transported into the passageway.

In an embodiment, the automatic document feeder further includes a transfer module disposed in the vicinity of the paper-feeding mechanism for transporting the uppermost paper sheet fed by the paper-feeding mechanism to an image processing module.

In an embodiment, the automatic document feeder further includes an ejection module disposed in the vicinity of the transfer module for ejecting the uppermost paper sheet which has been processed by the image processing module.

In an embodiment, the automatic document feeder further includes a paper eject tray, wherein the uppermost paper sheet which has been processed by the image processing module is ejected to the paper eject tray.

The above contents of the present invention will become more readily apparent to those ordinarily skilled in the art after reviewing the following detailed description and accompanying drawings, in which:

BRIEF DESCRIPTION OF THE DRAWINGS

FIG. 1(*b*) is a schematic perspective view illustrating a paper stopping module of the automatic document feeder in FIG. 1(*a*);

FIG. 2(*b*) is a schematic perspective view illustrating a paper-feeding mechanism of the automatic document feeder in FIG. 2(*a*);

FIG. 2(*c*) is a schematic perspective view illustrating the connection between the paper-feeding mechanism and an actuating mechanism.

FIG. 2(*d*) is a schematic perspective view illustrating the paper-feeding mechanism of the automatic document feeder in FIG. 2(*a*) at a paper-feeding position;

FIG. 2(*e*) is a schematic cross-sectional view illustrating the automatic document feeder at the paper-feeding position; and FIG. 2(*f*) is a schematic partial perspective view illustrating the automatic document feeder of FIG. 2(*e*).

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
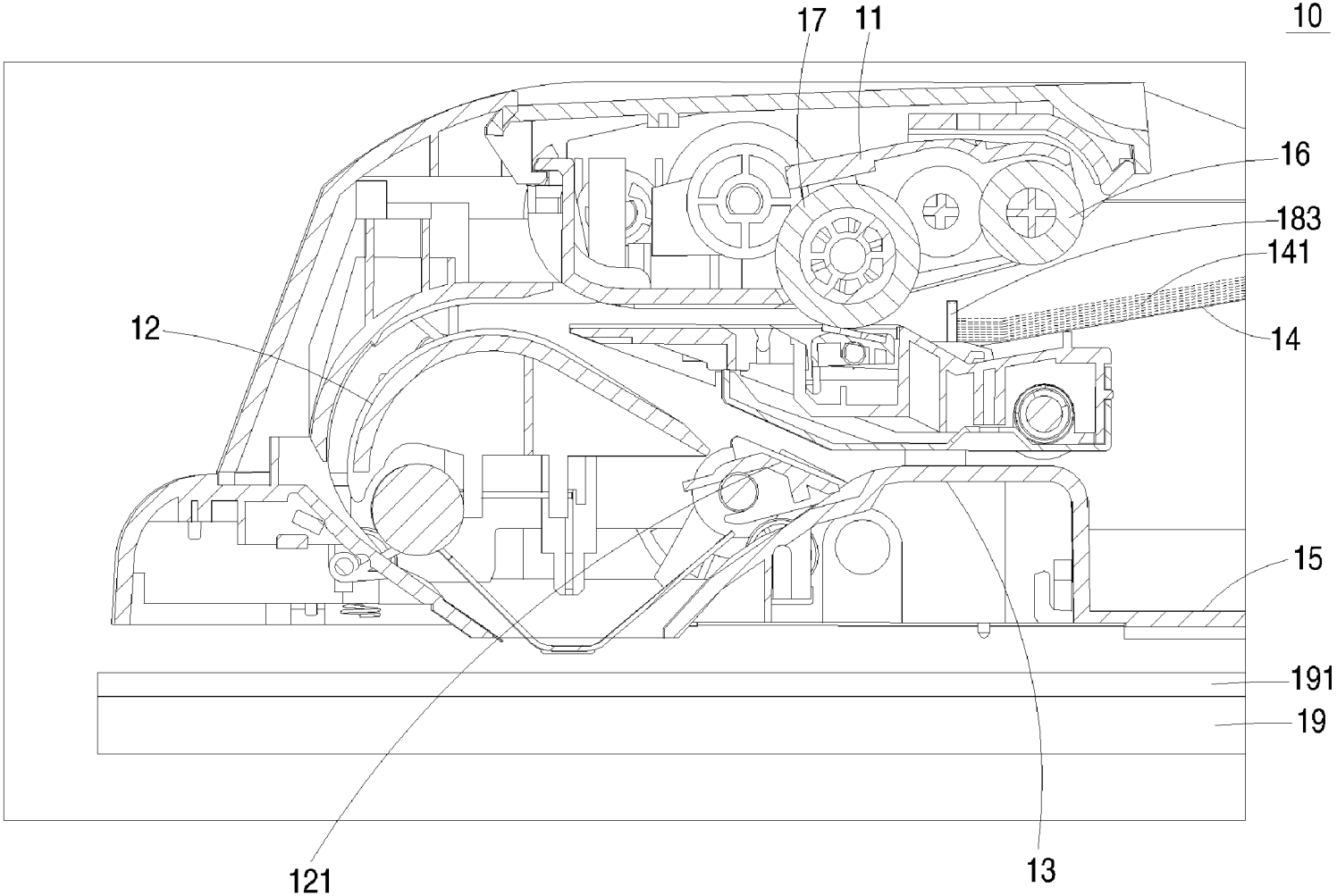
Fig. 1(a) Prior Art
FIG. 1(*a*) is a schematic cross-sectional view illustrating a conventional automatic document feeder for use with an office machine.
Figure 1B:
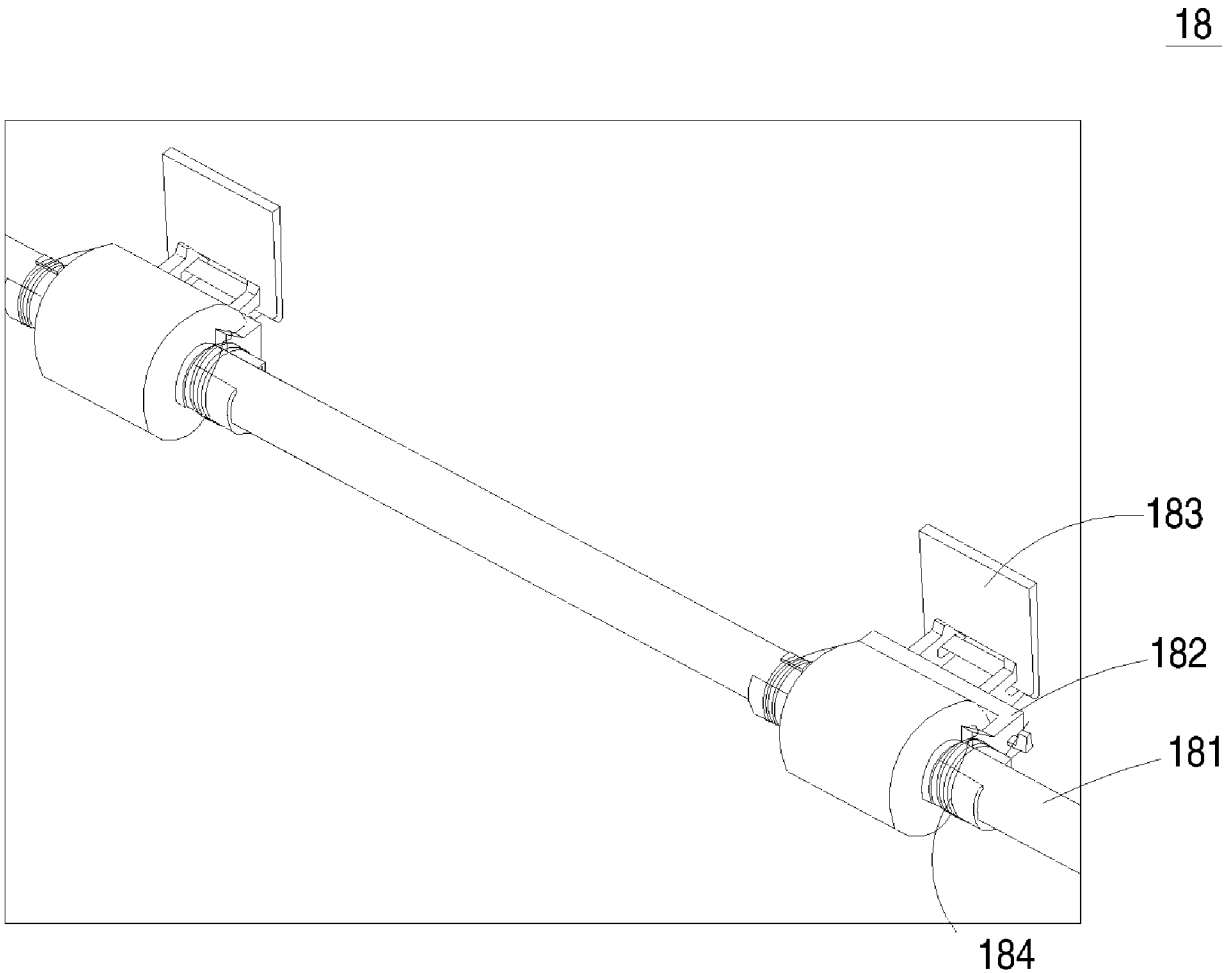
Fig. 1(b) Prior Art
Figure 2A:
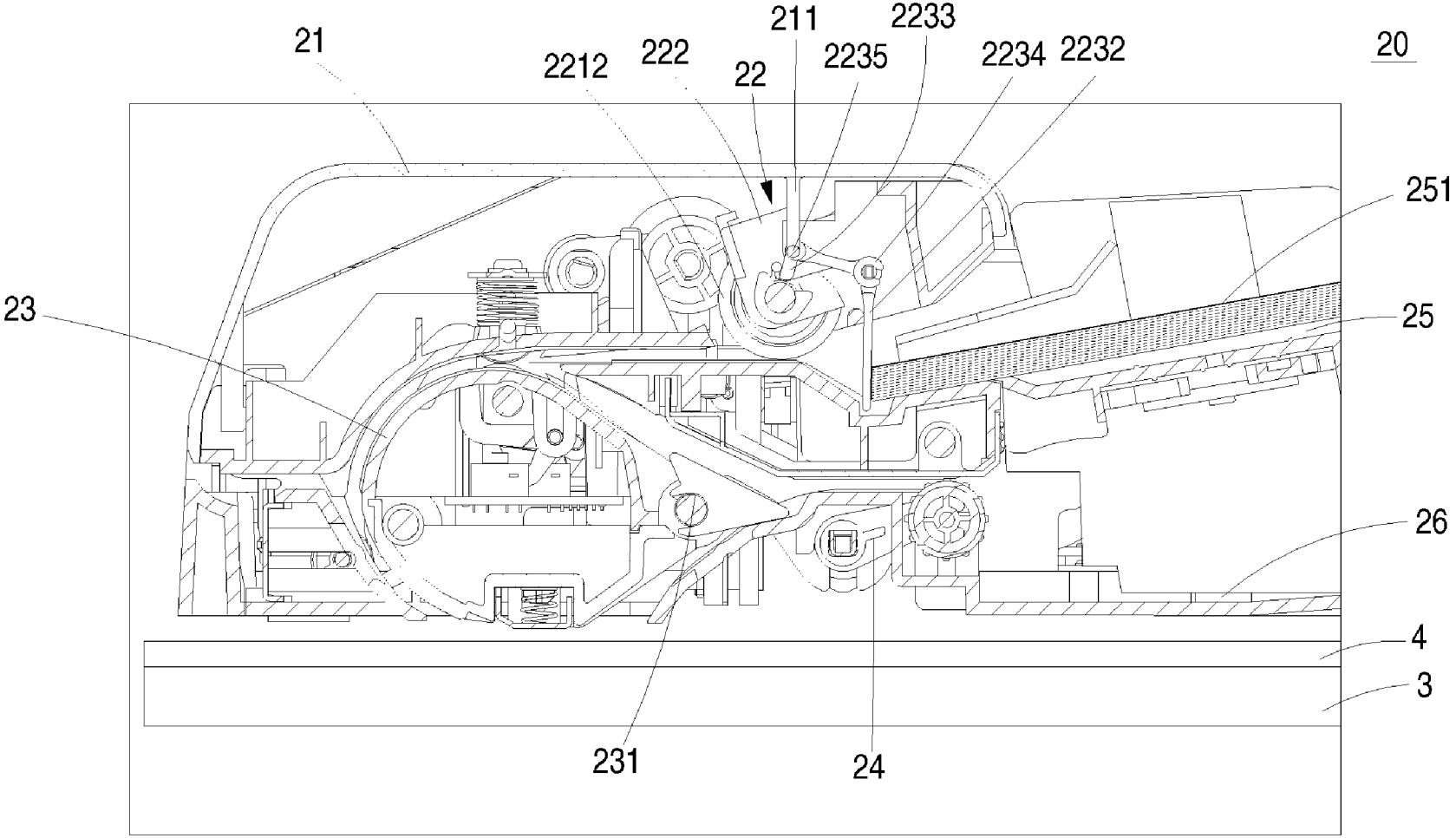
FIG. 2(*a*) is a schematic cross-sectional view illustrating an automatic document feeder at a standby position according to a preferred embodiment of the present invention.
Figure 2B:
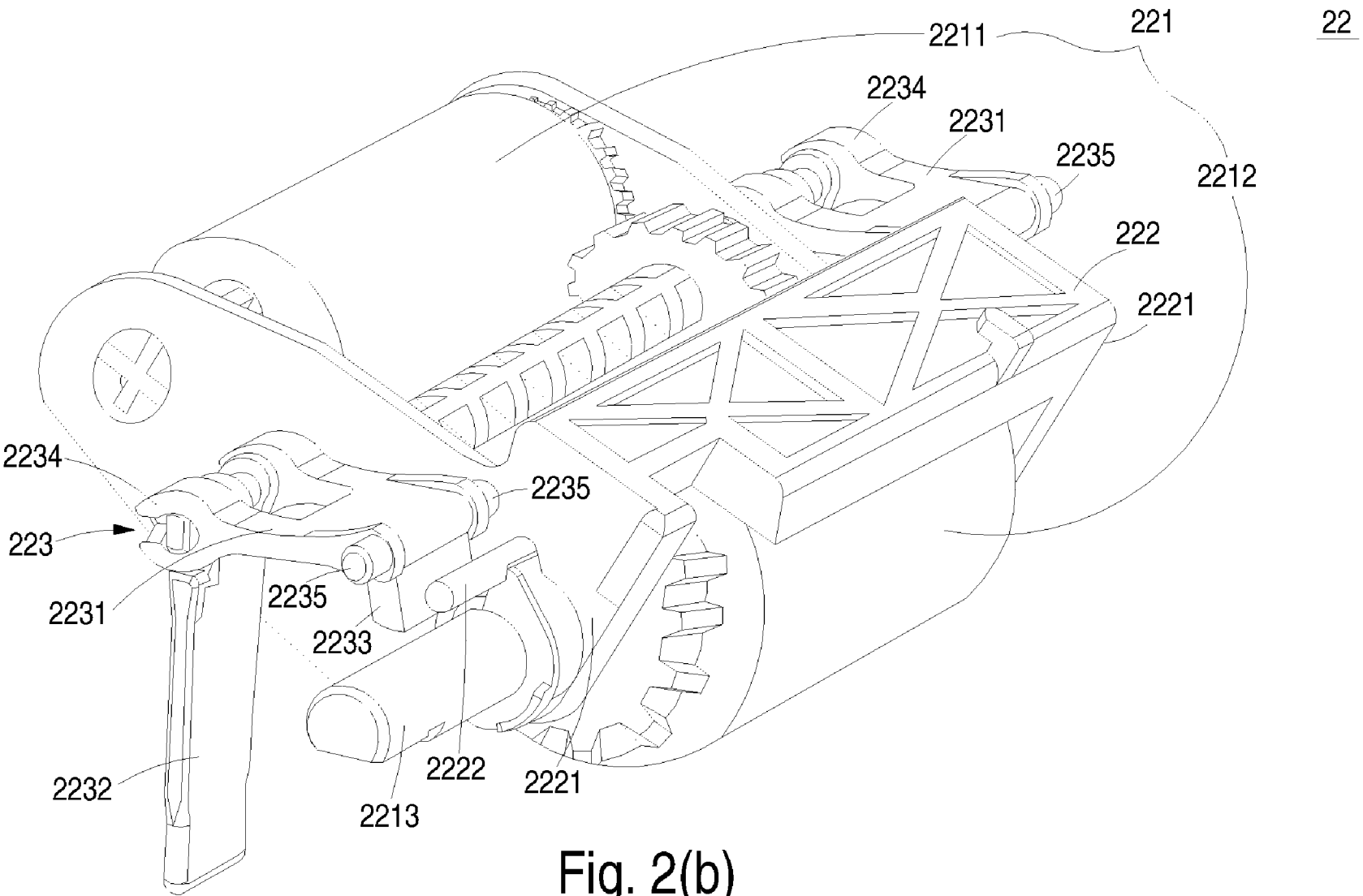
Figure 2C:
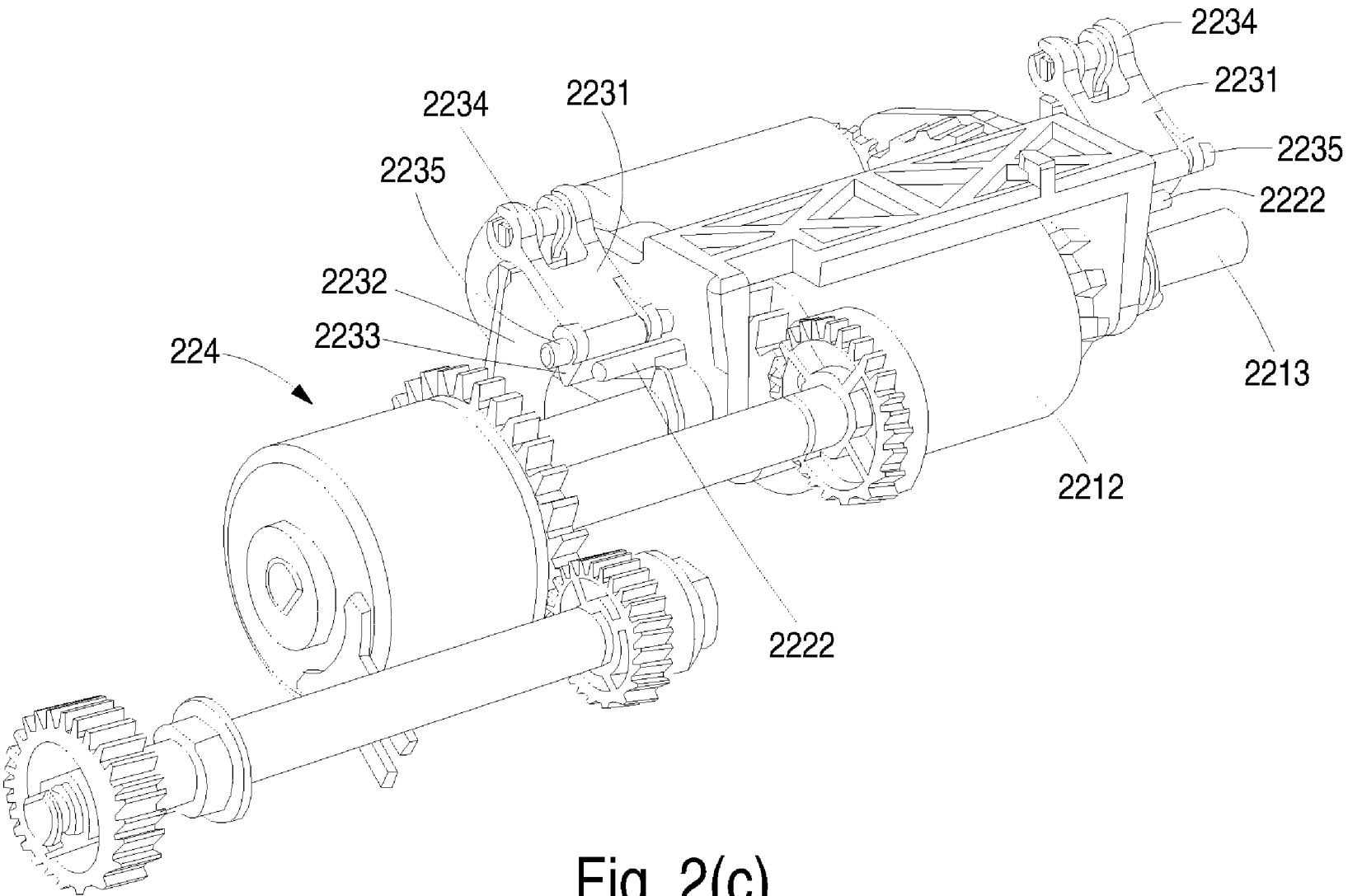
Figure 2D:
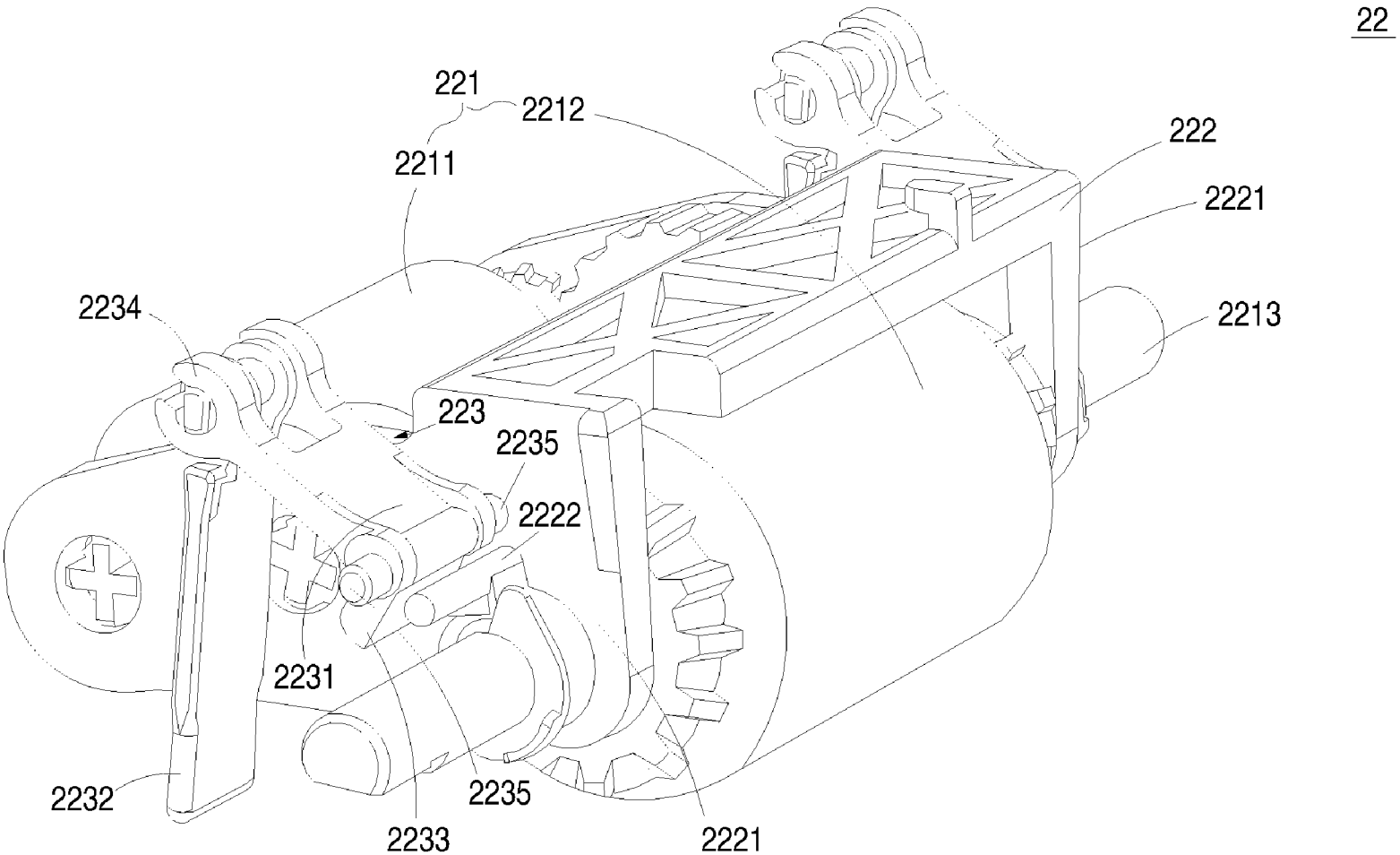
Figure 2E:
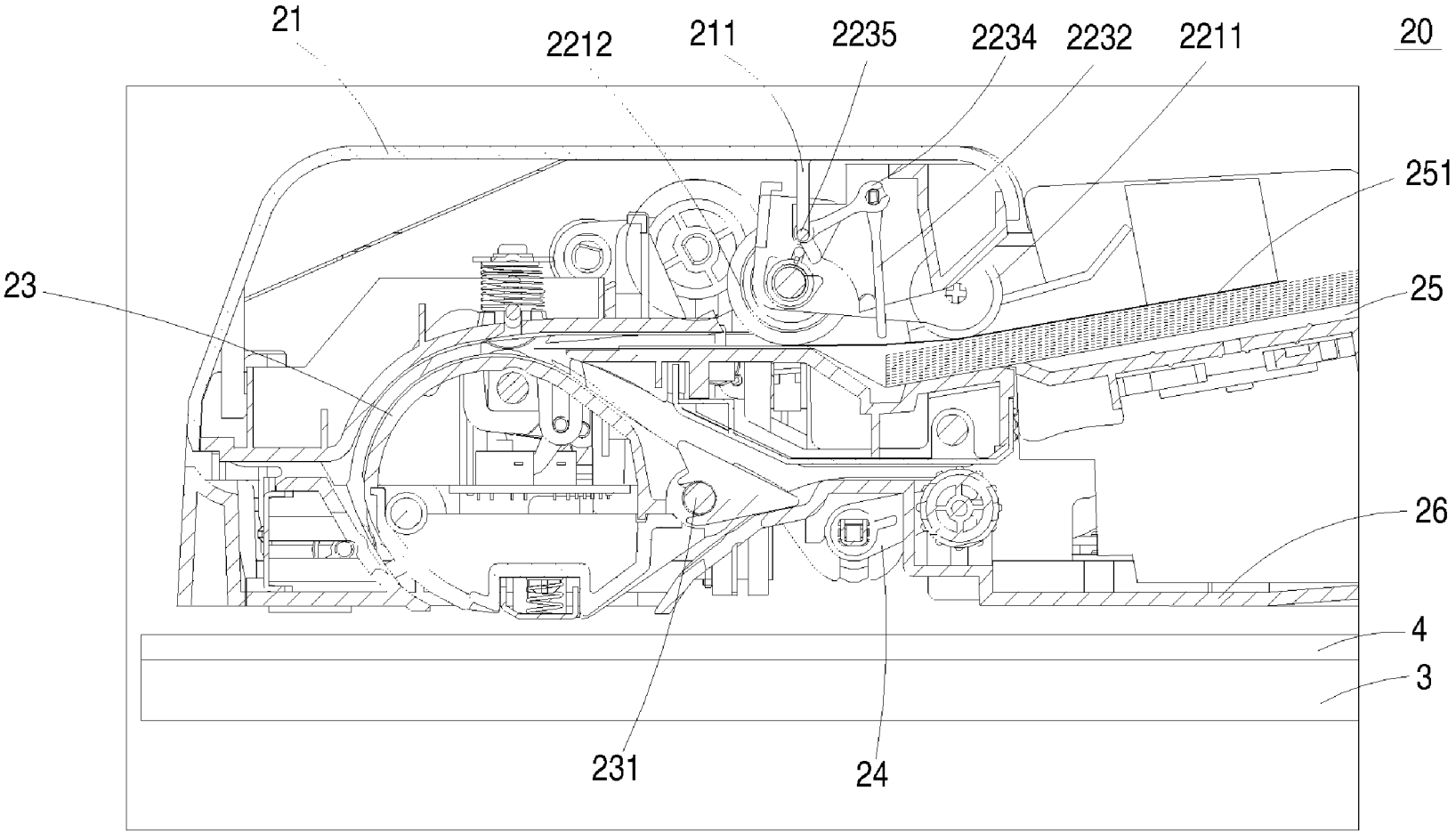
Figure 2F:
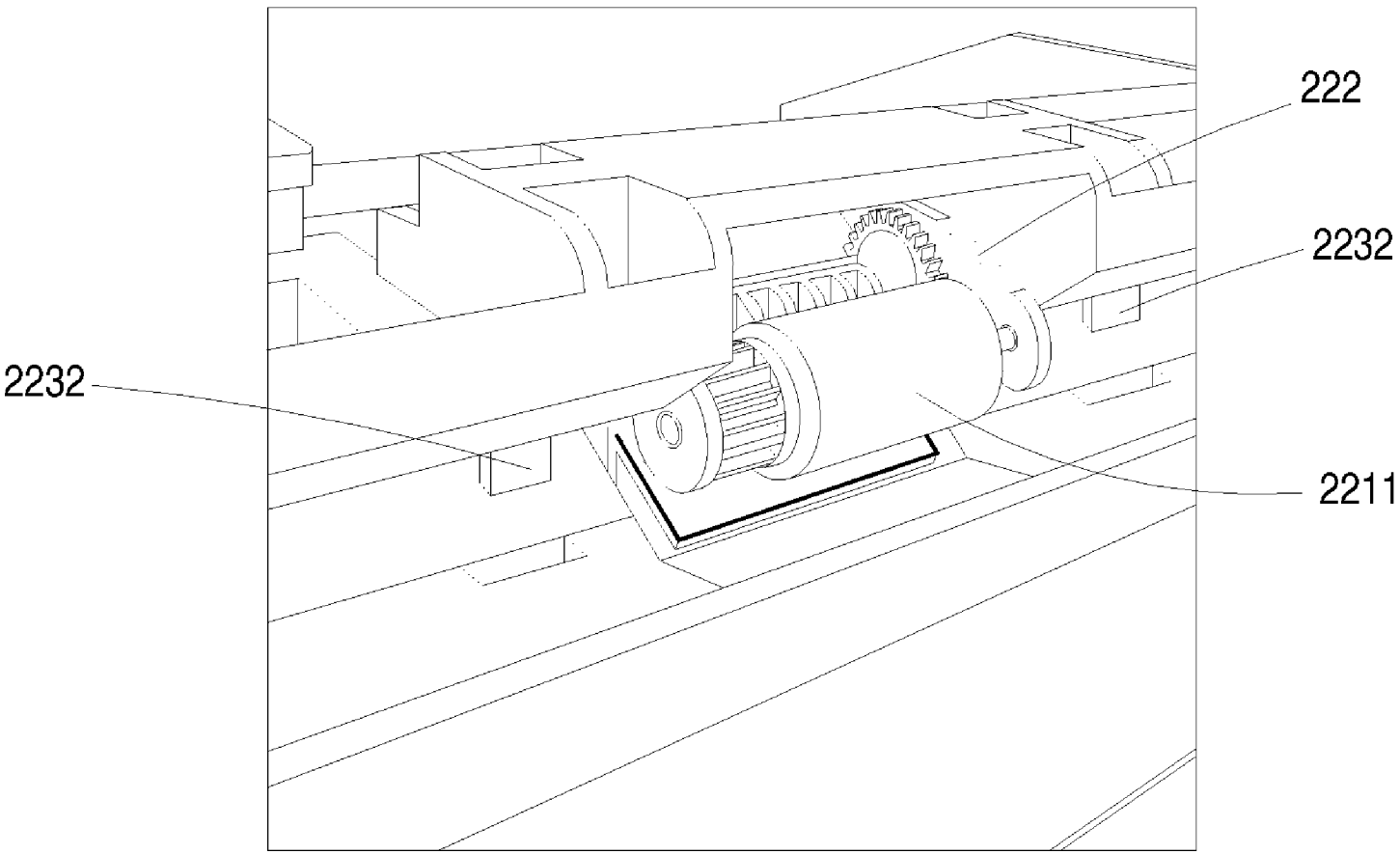

Referring to FIG. 2(*a*), a schematic cross-sectional view of an automatic document feeder for use with an office machine according to a preferred embodiment of the present invention is illustrated. The automatic document feeder 20 principally includes a casing 21, a paper-feeding mechanism 22, a transfer module 23, an ejection module 24, a paper input tray 25 and a paper ejecting tray 26. As shown in FIG. 2(*a*), the paper-feeding mechanism 22 is at a standby position. The office machine further includes an image processing module 3 and a glass platform 4 under the automatic document feeder 20. The office machine of the present invention includes but is not limited to a printer, a scanner, a fax machine, a copy machine or a multifunction peripheral. Hereinafter, the present invention is illustrated by referring to a scanner.

After a stack of paper sheets 251 to be scanned are placed on the paper input tray 25, the paper-feeding mechanism 22 may successively pick the uppermost paper sheets one by one into the passageway within the automatic document feeder 20. Next, the paper sheet 251 is transported by the transfer module 23 across the glass platform 4 so that a first side of the paper sheet 251 is scanned by the image processing module 3. The paper sheet 251 whose first side has been scanned is then ejected to the paper ejecting tray 26 by the ejection module 24. For a purpose of performing a duplex scanning operation, the transfer module 23 further includes an inverting member 231 adjacent to the ejection module 24. After the first side of the paper sheet 251 has been scanned and a majority of the paper sheet 251 is ejected to the paper ejecting tray 26, the paper sheet 251 is turned over by the inverting member 231 and then fed into the passageway. Next, the paper sheet 251 is transported by the transfer module 23 across the glass platform 4 so that a second side of the paper sheet 251 is scanned by the image processing module 3.

FIG. 2(*b*) is a schematic perspective view illustrating a paper-feeding mechanism of the automatic document feeder in FIG. 2(*a*). Please refer to FIGS. 2(*a*) and 2(*b*). The paper-feeding mechanism 22 principally includes a pick-up module 221, a supporting module 222 and a paper stopping module 223. The pick-up module 221 is disposed in the vicinity of the paper input tray 25, and includes a pick-up roller 2211 and a separation roller 2212. The separation roller 2212 is disposed in the vicinity of the pick-up roller 2211 and sheathed around a separation roller axle 2213. The supporting module 222 is used for supporting the pick-up module 221. Both ends of the supporting module 222 are also sheathed around the separation roller axle 2213 of the separation roller 2212, so that the supporting module 222 is pivotal about the separation roller axle 2213 when the separation roller axle 2213 is driven by an actuating mechanism 224 (as shown FIG. 2(*c*)). Upon rotation of the supporting module 222, the pick-up roller 2211 and the separation roller 2212 are either ascended or descended. When the pick-up roller 2211 is descended to contact with the paper sheet 251, the paper sheet 251 is fed by the pick-up roller 2211. The separation roller 2212 is rotated to separate the uppermost paper sheet 251 from the stack of paper sheets, thereby picking a single paper sheet to the transfer module 23.

The supporting module 222 has two sustaining parts 2222 on bilateral sides 2221 thereof, respectively. An exemplary sustaining part 222 is a protrusion, which may be integrally formed on the sidewall 2221 of the supporting module 222. As the supporting module 222 is rotated, the sustaining part 2222 is rotated.

The paper stopping module 223 is disposed beside the sidewall 2221 of the supporting module 222 and between the pick-up roller 2211 and the separation roller 2212. When the pick-up roller 2211 of the pick-up module 221 is lifted to a standby position as shown in FIGS. 2(*a*) and 2(*b*), the paper stopping module 223 is sustained against the front edges of the stack of paper sheets 251 on the paper input tray 25 such that the paper sheets 251 are hindered from being transported into the paper feeding port. Whereas, when the pick-up roller 2211 of the pick-up module 221 is lowered to the paper-feeding position as shown in FIG. 2(*e*), the uppermost paper sheet may be transported into the paper feeding port without being stopped by the paper stopping module 223. Please refer to FIG. 2(*b*) again. The paper stopping module 223 includes two transmission members 2231 and two stopping plates 2232. In this embodiment, the transmission member 2231 has an L-shaped cross-section. The short side of the L-shaped transmission member 2231 has a contact part 2233 to be contacted with the sustaining part 2222 of the supporting module 222. The long side of the L-shaped transmission member 2231 has a clamp part 2234 for clamping the upper edge of the stopping plate 2232. Since the upper edge of the stopping plate 2232 is clamped by the clamp part 2234, the stopping plate 2232 is vertically uplifted or lowered. In addition, a pivotal shaft 2235 is disposed at the right-angle corner of the L-shaped transmission member 2231, i.e. the connection region of the clamp part 2234 and the contact part 2233. The transmission member 2231 is pivotal about the pivotal shaft 2235.

In accordance with a feature of the present invention, a grasp arm 211 is protruded from an inner surface of the casing 21 for grasping both terminals of the pivotal shaft 2235, as can be seen in FIGS. 2(*a*) and 2(*e*). As a result, the paper stopping module 223 is disposed beside the sidewalls 2221 of the supporting module 222 and the contact parts 2233 of the transmission members 2231 are arranged beside corresponding sustaining parts 2222 of the supporting module 22.

Please refer to FIGS. 2(*a*) and 2(*b*) again. In a case that no paper-feeding instruction is received by the control circuit inside the automatic document feeder 20, the pick-up roller 2211 is raised to a standby position without contact with the paper sheets 251. Meanwhile, the contact part 2233 of the transmission member 2231 is not suppressed by the sustaining part 2222 of the supporting module 22. Due to the weight of the paper stopping module 223, the stopping plate 2232 is lowered to a paper-stopping position where the stopping plate 2232 is sustained against the front edges of the stack of paper sheets 251. Under this circumstance, the paper sheets are hindered from being transported into the paper feeding port.

Please refer to FIGS. 2(*d*), 2(*e*) and 2(*f*). In a case that a paper-feeding instruction is received by the control circuit inside the automatic document feeder 20, the supporting module 222 and the pick-up roller 2211 are driven by the actuating mechanism 224 to rotate downwardly to the lowermost position. Upon downward rotation of the supporting module 222, the sustaining part 2222 is rotated downwardly to push forward the contact part 2233 of the L-shaped transmission member 2231. Since the transmission member 2231 is pivotal about the pivotal shaft 2235, the stopping plate 2232 is uplifted vertically. Until the pick-up roller 2211 contacts with the uppermost paper sheet 251, the stopping plate 2232 is fixed at the paper-feeding position. Meanwhile, the uppermost paper sheet 251 may be transported into the paper feeding port without being stopped by the stopping plate 2232.

When a sensor (not shown) of the automatic document feeder 20 detects that any paper sheet 251 has been fed into the paper feeding port, the supporting module 222 and the pick-up roller 2211 are driven by the actuating mechanism 224 to rotate upwardly to the initial position as shown in FIG. 2(*a*). Meanwhile, the contact part 2233 of the transmission member 2231 is not suppressed by the sustaining part 2222 of the supporting module 22. Due to the weight of the paper stopping module 223, the stopping plate 2232 is lowered to a paper-stopping position where the stopping plate 2232 is sustained against the front edges of the stack of paper sheets 251. Under this circumstance, the paper sheets are hindered from being transported into the paper feeding port. Until the paper sheet 251 is ejected to the paper ejecting tray 26, the above procedures are repeated to successively feed the remainder paper sheets one by one.

For a purpose of performing a duplex scanning operation, after the first side of the paper sheet 251 has been scanned and a majority of the paper sheet 251 is ejected to the paper ejecting tray 26, the paper sheet 251 is turned over by the inverting member 231 and then transported into the passageway. Next, the paper sheet 251 is transported by the transfer module 23 across the glass platform 4 so that a second side of the paper sheet 251 is scanned by the image processing module 3. Since the paper sheet 251 comes from the paper ejecting tray 26 rather than the paper input tray 25 at the moment when the paper sheet 251 is turned over by the inverting member 231 and transported into the passageway, the supporting module 222 and the pick-up roller 2211 may be kept at the initial position as shown in FIGS. 2(*a*) and 2(*b*). Under this circumstance, the remainder paper sheets 251 are hindered from being transported into the paper feeding port.

From the above embodiment, for performing the duplex scanning operation by using the automatic document feeder of the present invention, the redundant procedure of rotating the stopping plate when the paper sheet is turned over and fed into the passageway may be dispensed with. As a consequence, the remainder paper sheets are precisely positioned on the paper input tray so as to enhance the performance of stopping the paper sheets. Moreover, since the stopping plate of the paper stopping module is moved to the paper-feeding position or the paper-stopping position upon downward or upward rotation of the supporting module and the pick-up module, no addition motor is required to drive the pivotal shaft of the paper stopping module. Therefore, the fabricating cost of the automatic document feeder is reduced and the operating burden is also reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper-feeding mechanism of an automatic document feeder, said paper-feeding mechanism being coupled with a casing of said automatic document feeder for successively feeding a stack of paper sheets on a paper input tray, said paper-feeding mechanism comprising:

a pick-up module disposed in the vicinity of said paper input tray for picking an uppermost paper sheet from said stack of paper sheets and transporting said uppermost paper sheet into a passageway inside said automatic document feeder;

a supporting module for supporting said pick-up module and rotated to either ascend or descend said pick-up module, wherein said supporting module has a sustaining part on a sidewall thereof; and a paper stopping module coupled to said casing and including a stopping plate and a transmission member, a first end of said transmission member being in contact with said sustaining part, a second end of said transmission member being coupled with said stopping plate, wherein said stopping plate is moved to a paper-feeding position for allowing said uppermost paper sheet to be transported into said passageway when said supporting module and said pick-up module are downwardly rotated, and said stopping plate is moved to a paper-stopping position for hindering said uppermost paper sheet from being transported into said passageway when said supporting module and said pick-up module are upwardly rotated.

2. The paper-feeding mechanism according to claim 1 wherein said pick-up module includes a pick-up roller and a separation roller for picking said uppermost paper sheet from said stack of paper sheets and transporting said uppermost paper sheet into a passageway.

3. The paper-feeding mechanism according to claim 2 wherein said separation roller includes a separation roller axle, and said supporting module is pivotal about said separation roller axle.

4. The paper-feeding mechanism according to claim 1 wherein said transmission member includes:

a contact part to be contacted with said sustaining part of said supporting module; and a clamp part for clamping an upper edge of said stopping plate.

5. The paper-feeding mechanism according to claim 4 wherein a pivotal shaft is disposed at a connection region of said clamp part and said contact part, and a grasp arm is protruded from an inner surface of said casing for grasping both terminals of said pivotal shaft.

6. An automatic document feeder comprising:

a casing;

a paper input tray for placing a stack of paper sheets thereon;

a paper-feeding mechanism disposed in the vicinity of said paper input tray and comprising:

a pick-up module disposed in the vicinity of said paper input tray for picking an uppermost paper sheet from said stack of paper sheets and transporting said uppermost paper sheet into a passageway inside said automatic document feeder;

a supporting module for supporting said pick-up module and rotated to either ascend or descend said pick-up module, wherein said supporting module has a sustaining part on a sidewall thereof; and a paper stopping module coupled to said casing and including a stopping plate and a transmission member, a first end of said transmission member being in contact with said sustaining part, a second end of said transmission member being coupled with said stopping plate, wherein said stopping plate is moved to a paper-feeding position for allowing said uppermost paper sheet to be transported into said passageway when said supporting module and said pick-up module are downwardly rotated, and said stopping plate is moved to a paper-stopping position for hindering said uppermost paper sheet from being transported into said passageway when said supporting module and said pick-up module are upwardly rotated.

7. The automatic document feeder according to claim 6 further comprising a transfer module disposed in the vicinity of said paper-feeding mechanism for transporting said uppermost paper sheet fed by said paper-feeding mechanism to an image processing module.

8. The automatic document feeder according to claim 7 further comprising an ejection module disposed in the vicinity of said transfer module for ejecting said uppermost paper sheet which has been processed by said image processing module.

9. The automatic document feeder according to claim 8 further comprising a paper eject tray, wherein said uppermost paper sheet which has been processed by said image processing module is ejected to said paper eject tray.

10. The automatic document feeder according to claim 6 wherein said pick-up module includes a pick-up roller and a separation roller for picking said uppermost paper sheet from said stack of paper sheets and transporting said uppermost paper sheet into a passageway.

11. The automatic document feeder according to claim 10 wherein said separation roller includes a separation roller axle, and said supporting module is pivotal about said separation roller axle.

12. The automatic document feeder according to claim 6 wherein said transmission member includes:

a contact part to be contacted with said sustaining part of said supporting module; and a clamp part for clamping an upper edge of said stopping plate.

13. The automatic document feeder according to claim 12 wherein a pivotal shaft is disposed at a connection region of said clamp part and said contact part, and a grasp arm is protruded from an inner surface of said casing for grasping both terminals of said pivotal shaft.

* * * * *